US011447932B2

(12) United States Patent
Takaoka

(10) Patent No.: US 11,447,932 B2
(45) Date of Patent: Sep. 20, 2022

(54) CONTROL SYSTEM AND METHOD FOR WORK MACHINE, AND WORK MACHINE

(71) Applicant: KOMATSU LTD., Tokyo (JP)

(72) Inventor: Yukihisa Takaoka, Tokyo (JP)

(73) Assignee: KOMATSU LTD., Tokyo (JP)

( * ) Notice: Subject to any disclaimer, the term of this patent is extended or adjusted under 35 U.S.C. 154(b) by 351 days.

(21) Appl. No.: 16/638,893

(22) PCT Filed: Aug. 6, 2018

(86) PCT No.: PCT/JP2018/029399

§ 371 (c)(1),
(2) Date: Feb. 13, 2020

(87) PCT Pub. No.: WO2019/187192

PCT Pub. Date: Oct. 3, 2019

(65) Prior Publication Data

US 2020/0362541 A1 Nov. 19, 2020

(30) Foreign Application Priority Data

Mar. 29, 2018 (JP) ..... JP2018-065754

(51) Int. Cl.

*E02F 9/26* (2006.01)
*E02F 3/84* (2006.01)
*E02F 9/22* (2006.01)

(52) U.S. Cl.

CPC ..... *E02F 9/262* (2013.01); *E02F 3/844* (2013.01); *E02F 9/265* (2013.01); *E02F 9/2228* (2013.01)

(58) Field of Classification Search

CPC ..... E02F 9/2045; E02F 9/24; E02F 9/26; E02F 9/261; E02F 9/262; E02F 3/76; E02F 3/84; E02F 3/841; E02F 3/844

See application file for complete search history.

(56) References Cited

U.S. PATENT DOCUMENTS 9,014,922 B2 * 4/2015 Edara ..... E02F 9/205 701/50
9,297,147 B1 * 3/2016 Wei ..... E02F 9/2045
2016/0040397 A1 * 2/2016 Kontz ..... G05B 13/04 701/400

(Continued)

FOREIGN PATENT DOCUMENTS

JP 2017-14726 A 1/2017

OTHER PUBLICATIONS

International Search Report for the corresponding international application No. PCT/JP2018/029399, dated Oct. 23, 2018.

*Primary Examiner* — Russell Frejd
*Assistant Examiner* — Sara J Lewandroski
(74) *Attorney, Agent, or Firm* — Global IP Counselors, LLP

(57) ABSTRACT

A work machine includes a work implement. A control system for the work machine includes a controller. The controller acquires cliff position data. The cliff position data indicates a position of a cliff included in an actual topography of a work site. The controller determines a target design topography located below the actual topography. The controller determines an end position of work by the work implement from the cliff position data. The controller generates a command signal to move a work implement according to the end position and the target design topography.

12 Claims, 10 Drawing Sheets

(56) References Cited

U.S. PATENT DOCUMENTS

| | | | | |
|---|---|---|---|---|
| 2016/0090700 | A1* | 3/2016 | Tanaka | B60W 30/18109 701/532 |
| 2016/0201298 | A1* | 7/2016 | Taylor | E02F 3/844 701/50 |
| 2017/0153717 | A1* | 6/2017 | Moore | G06F 3/04847 |
| 2018/0150779 | A1* | 5/2018 | Wei | G05D 1/0276 |

* cited by examiner

CONTROL SYSTEM AND METHOD FOR WORK MACHINE, AND WORK MACHINE

CROSS-REFERENCE TO RELATED APPLICATIONS

This application is a U.S. National stage application of International Application No. PCT/JP2018/029399, filed on Aug. 6, 2018. This U.S. National stage application claims priority under 35 U.S.C. § 119(a) to Japanese Patent Application No. 2018-065754, filed in Japan on Mar. 29, 2018, the entire contents of which are hereby incorporated herein by reference.

BACKGROUND

Field of the Invention

The present invention relates to a control system and method for a work machine, and a work machine.

Background Information

Conventionally, in a work machine such as a bulldozer or a grader, a system for automatically controlling the work machine has been proposed. For example, in the system of U.S. Pat. No. 9,014,922, a controller determines in advance a target profile to be moved by a work implement at a work site from a topography of the work site. The controller determines a plurality of cut locations so as to dig in each of work sections along the target profile. The controller starts digging from the determined cut location and moves the work implement according to the target profile.

SUMMARY

Work of work machines includes transporting dug material to a nearby cliff and dropping it off a cliff, such as mining. When such work is performed by automatic control of a work machine, it is preferable to set an end position of the work at a position before the cliff. A controller advance the work machine to the end position while pushing the material, and when the work machine has reached the end position, the controller retracts the work machine.

However, the actual position and shape of the cliff changes according to the progress of the work. Therefore, it is not easy to appropriately set the end position. If a position far away from the cliff is set as the end position, the material that cannot be completely dropped remains at the edge of the cliff. In that case, it becomes difficult to create a desired topography.

An object of the present invention is to create a desired topography when working near a cliff by automatic control of a work machine.

A first aspect is a control system for a work machine including a work implement and the control system includes a controller. The controller is programmed to perform following processing. The controller acquires cliff position data. The cliff position data indicates a position of a cliff included in an actual topography of a work site. The controller determines a target design topography located below the actual topography. The controller determines an end position of work by the work implement from the cliff position data. The controller generates a command signal to move the work implement according to the end position and the target design topography.

A second aspect is a method performed by a controller for controlling a work machine including a work implement and the method includes following processes. A first process is to acquire cliff position data. The cliff position data indicates a position of a cliff included in an actual topography of a work site. A second process is to determine a target design topography located below the actual topography. A third process is to determine an end position of work by the work implement from the cliff position data. A fourth process is to generate a command signal to move the work implement according to the end position and the target design topography.

A third aspect is a work machine including a work implement and a controller for controlling the work implement. The controller is programmed to perform the following processing. The controller acquires cliff position data. The cliff position data indicates a position of a cliff included in an actual topography of a work site. The controller determines a target design topography located below the actual topography. The controller determines an end position of work by the work implement from the cliff position data. The controller generates a command signal to move the work implement according to the end position and the target design topography.

Advantageous Effects of Invention

In the present invention, the cliff position data indicative of the position of the cliff is acquired, and the end position of the work is determined from the cliff position data. Therefore, the end position can be determined according to the actual change in the position or shape of the cliff. Thereby, desired topography can be created.

DETAILED DESCRIPTION OF EMBODIMENT(S)

Figure 1:
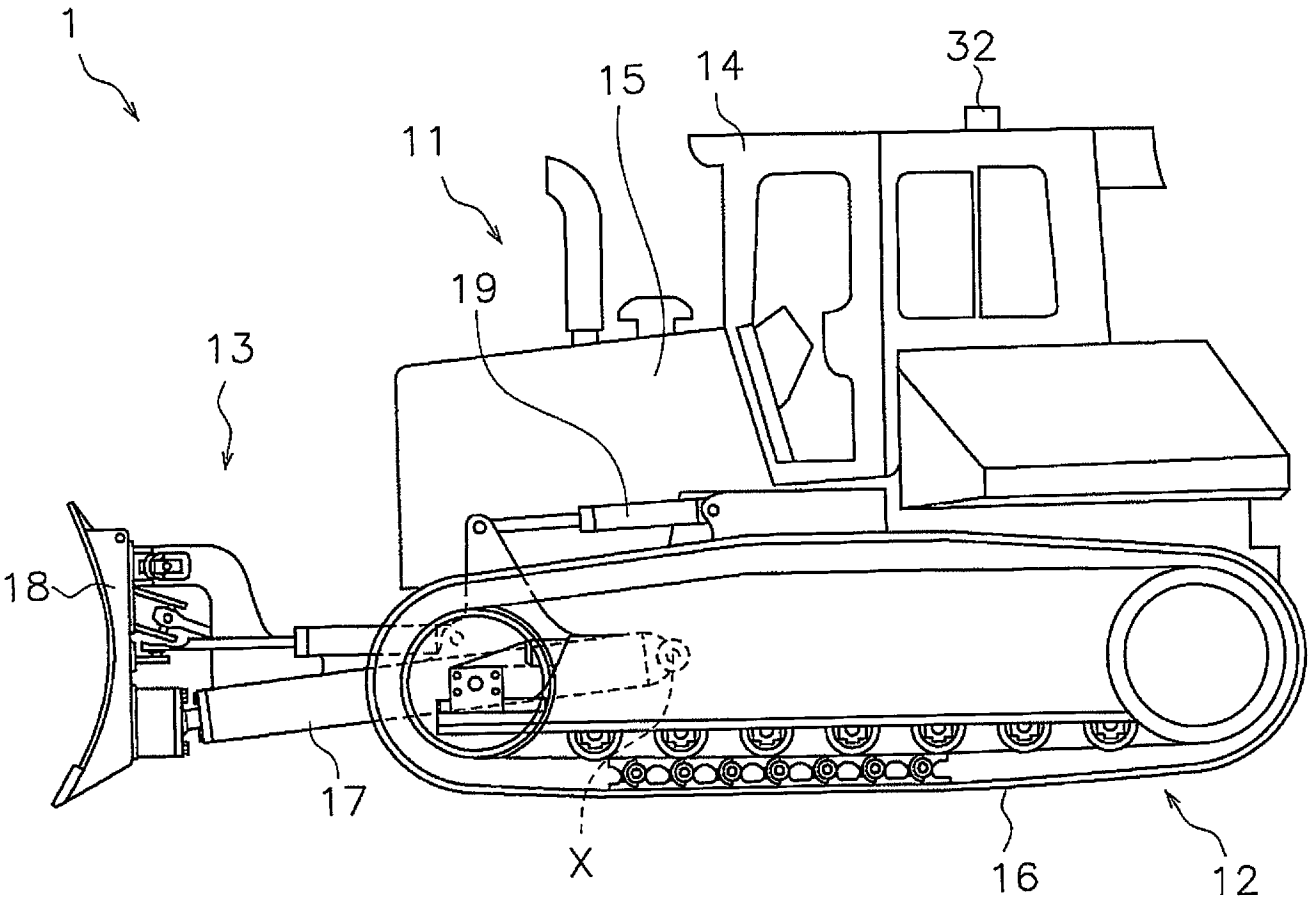
FIG. 1 is a side view showing a work machine according to an embodiment.

A work vehicle according to an embodiment will now be described with reference to the drawings. FIG. 1 is a side view of a work machine 1 according to an embodiment. The work machine 1 according to the present embodiment is a bulldozer. The work machine 1 includes a vehicle body 11, a travel device 12, and a work implement 13.

The vehicle body 11 includes an operating cabin 14 and an engine compartment 15. An operator's seat that is not illustrated is disposed in the operating cabin 14. The engine compartment 15 is disposed in front of the operating cabin 14. The travel device 12 is attached to a bottom portion of the vehicle body 11. The travel device 12 includes a pair of right and left crawler belts 16. Only the left crawler belt 16 is illustrated in FIG. 1. The work machine 1 travels due to the rotation of the crawler belts 16.

The work implement 13 is attached to the vehicle body 11. The work implement 13 includes a lift frame 17, a blade 18, and a lift cylinder 19. The lift frame 17 is attached to the vehicle body 11 so as to be movable up and down around an axis X extending in the vehicle width direction. The lift frame 17 supports the blade 18.

The blade 18 is disposed in front of the vehicle body 11. The blade 18 moves up and down as the lift frame 17 moves up and down. The lift frame 17 may be attached to the travel device 12. The lift cylinder 19 is coupled to the vehicle body 11 and the lift frame 17. Due to the extension and contraction of the lift cylinder 19, the lift frame 17 rotates up and down around the axis X.

Figure 2:
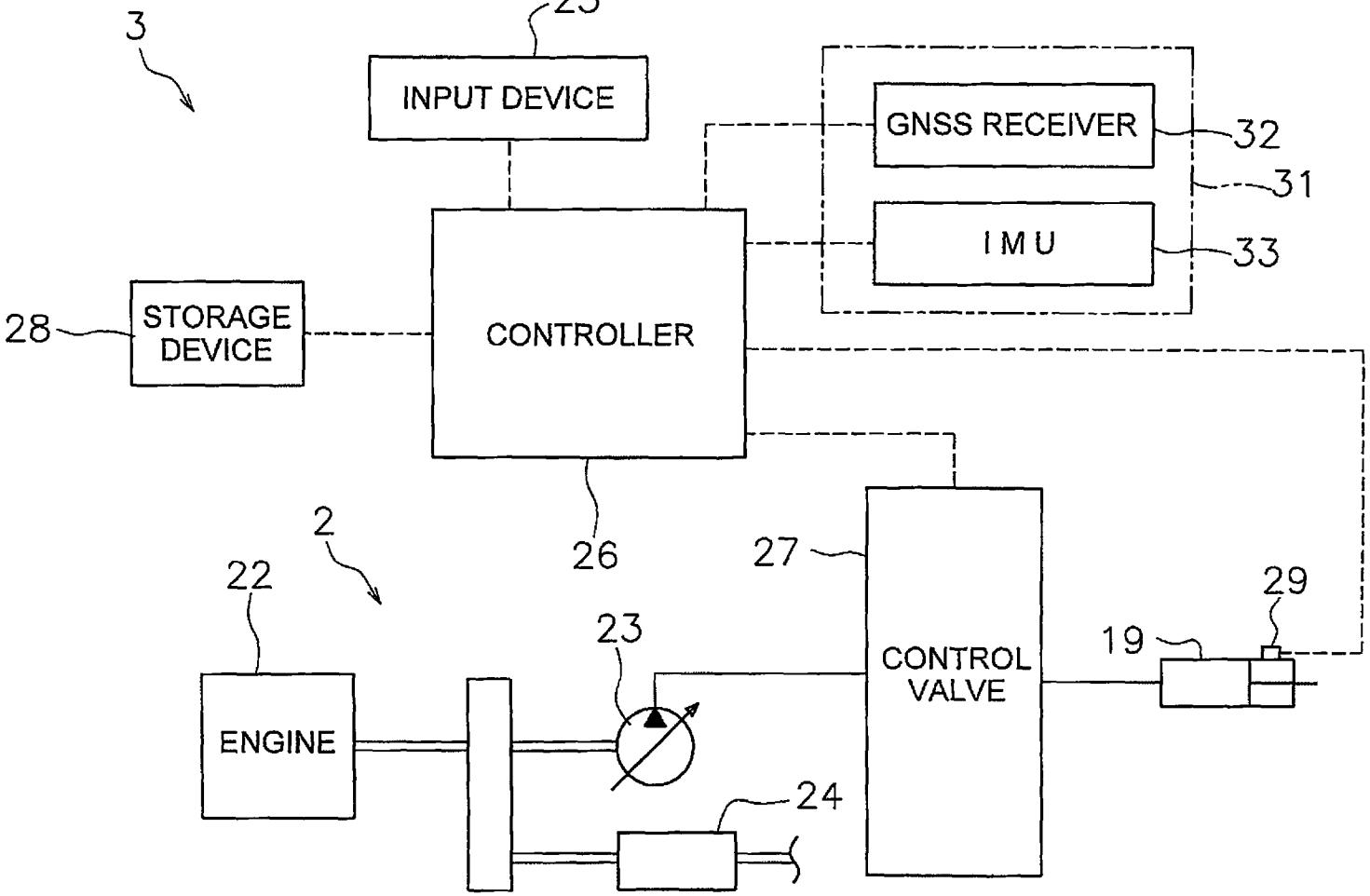
FIG. 2 is a block diagram showing a configuration of a drive system and a control system of the work machine.

FIG. 2 is a block diagram of a configuration of a drive system 2 and a control system 3 of the work machine 1. As illustrated in FIG. 2, the drive system 2 includes an engine 22, a hydraulic pump 23, and a power transmission device 24.

The hydraulic pump 23 is driven by the engine 22 to discharge hydraulic fluid. The hydraulic fluid discharged from the hydraulic pump 23 is supplied to the lift cylinder 19. Although only one hydraulic pump 23 is illustrated in FIG. 2, a plurality of hydraulic pumps may be provided.

The power transmission device 24 transmits driving force of the engine 22 to the travel device 12. The power transmission device 24 may be a hydro static transmission (HST), for example. Alternatively, the power transmission device 24 may be, for example, a torque converter or a transmission including a plurality of transmission gears.

The control system 3 includes an input device 25, a controller 26, a storage device 28, and a control valve 27. The input device 25 is disposed in the operating cabin 14. The input device 25 is a device for setting automatic control of the work machine 1 described later. The input device 25 receives an operation by an operator and outputs an operation signal corresponding to the operation. The operation signal of the input device 25 is output to the controller 26.

The input device 25 includes, for example, a touch screen type display. The input device 25 is not limited to a touch screen type and may include hardware keys. The input device 25 may be disposed at a location (for example, a control center) that is away from the work machine 1. The operator may operate the work machine 1 from the input device 25 in the control center via wireless communication.

The controller 26 is programmed to control the work machine 1 based on acquired data. The controller 26 includes, for example, a processor such as a CPU. The controller 26 acquires an operation signal from the input device 25. The controller 26 is not limited to one unit and may be divided into a plurality of controllers. The controller 26 causes the work machine 1 to travel by controlling the travel device 12 or the power transmission device 24. The controller 26 moves the blade 18 up and down by controlling the control valve 27.

The control valve 27 is a proportional control valve and is controlled by a command signal from the controller 26. The control valve 27 is disposed between a hydraulic actuator such as the lift cylinder 19 and the hydraulic pump 23. The control valve 27 controls the flow rate of the hydraulic fluid supplied from the hydraulic pump 23 to the lift cylinder 19. The controller 26 generates a command signal to the control valve 27 so that the blade 18 operates. Accordingly, the lift cylinder 19 is controlled. The control valve 27 may be a pressure proportional control valve. Alternatively, the control valve 27 may be an electromagnetic proportional control valve.

Figure 3:
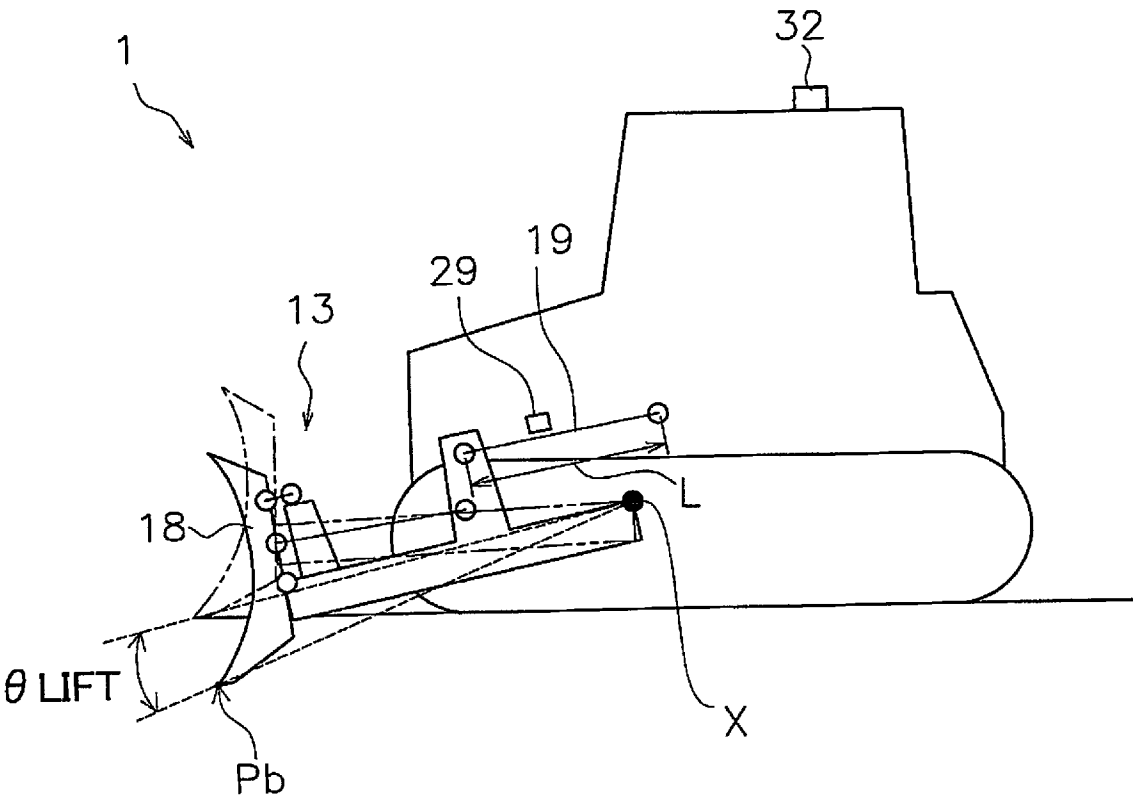
FIG. 3 is a schematic diagram showing a configuration of the work machine.

The control system 3 includes a work implement sensor 29. The work implement sensor 29 senses a position of the work implement 13 and outputs a work implement position signal indicative of the position of the work implement 13. The work implement sensor 29 may be a displacement sensor that senses the displacement of the work implement 13. Specifically, the work implement sensor 29 senses the stroke length of the lift cylinder 19 (hereinafter referred to as "lift cylinder length L"). As illustrated in FIG. 3, the controller 26 calculates a lift angle θlift of the blade 18 based on the lift cylinder length L. The work implement sensor 29 may be a rotation sensor that directly senses a rotation angle of the work implement 13.

FIG. 3 is a schematic view of a configuration of the work machine 1. In FIG. 3, a reference position of the work implement 13 is indicated by a chain double-dashed line. The reference position of the work implement 13 is a position of the blade 18 in a state where the tip of the blade 18 is in contact with the ground surface on a horizontal ground surface. The lift angle θlift is an angle from the reference position of the work implement 13.

As illustrated in FIG. 2, the control system 3 includes a position sensor 31. The position sensor 31 measures a position of the work machine 1. The position sensor 31 includes a global navigation satellite system (GNSS) receiver 32 and an IMU 33. The GNSS receiver 32 is, for example, a receiver for global positioning system (GPS). For example, an antenna of the GNSS receiver 32 is disposed on the operating cabin 14. The GNSS receiver 32 receives a positioning signal from a satellite and calculates the position of the antenna based on the positioning signal to generate vehicle body position data. The controller 26 acquires the vehicle body position data from the GNSS receiver 32. The controller 26 acquires the traveling direction and vehicle speed of the work machine 1 from the vehicle body position data.

The vehicle body position data may not be data of the antenna position. The vehicle body position data may be data indicative of the position of any location whose relationship with the antenna position is fixed in the work machine 1 or at the surroundings of the work machine 1.

The IMU 33 is an inertial measurement unit. The IMU 33 acquires vehicle body inclination angle data. The vehicle body inclination angle data includes an angle (pitch angle) with respect to the horizontal in the vehicle longitudinal direction and an angle (roll angle) with respect to the horizontal in the vehicle lateral direction. The controller 26 acquires the vehicle body inclination angle data from the IMU 33.

The controller 26 calculates a blade tip position Pb from the lift cylinder length L, the vehicle body position data, and the vehicle body inclination angle data. As illustrated in FIG. 3, the controller 26 calculates global coordinates of the GNSS receiver 32 based on the vehicle body position data. The controller 26 calculates the lift angle θlift based on the lift cylinder length L. The controller 26 calculates local coordinates of the blade tip position Pb with respect to the GNSS receiver 32 based on the lift angle θlift and vehicle body dimension data. The vehicle body dimension data is stored in the storage device 28 and indicates the position of the work implement 13 with respect to the GNSS receiver 32. The controller 26 calculates the global coordinates of the blade tip position Pb based on the global coordinates of the GNSS receiver 32, the local coordinate of the blade tip position Pb, and the vehicle body inclination angle data. The controller 26 acquires the global coordinates of the blade tip position Pb as blade tip position data.

The storage device 28 includes, for example, a memory and an auxiliary storage device. The storage device 28 may be a RAM, a ROM or the like. The storage device 28 may be a semiconductor memory, a hard disk or the like. The storage device 28 is an example of a non-transitory computer-readable recording medium. The storage device 28 stores computer commands that are executable by the processor and for controlling the work machine 1.

The storage device 28 stores design topography data and work site topography data. The design topography data indicates a final design topography. The final design topography is a final target shape of a surface of the work site. The design topography data is, for example, a construction drawing in a three-dimensional data format. The work site topography data indicates a wide topography of the work site. The work site topography data is, for example, an actual topography survey map of a three-dimensional data format. The work site topography data can be acquired by aerial laser survey, for example.

The controller 26 acquires actual topography data. The actual topography data indicates an actual topography of the work site. The actual topography of the work site is a topography of a region along the traveling direction of the work machine 1. The actual topography data is acquired by calculation in the controller 26 from the work site topography data and the position and traveling direction of the work machine 1 acquired from the aforementioned position sensor 31. The actual topography data may be acquired from distance measurement of the actual topography by, for example, a laser imaging detection and ranging (LIDAR) mounted on the vehicle.

The controller 26 automatically controls the work implement 13 based on the actual topography data, the design topography data, and the blade tip position data. The automatic control of the work implement 13 may be semi-automatic control performed in combination with manual operation by the operator. Alternatively, the automatic control of the work implement 13 may be fully automatic control performed without manual operation by an operator. The traveling of the work machine 1 may be automatically controlled by the controller 26. For example, the traveling control of the work machine 1 may be fully automatic control performed without manual operation by an operator. Alternatively, the traveling control may be semi-automatic control performed in combination with manual operation by the operator. Alternatively, the traveling of the work machine 1 may be performed with manual operation by the operator.

Figure 4:
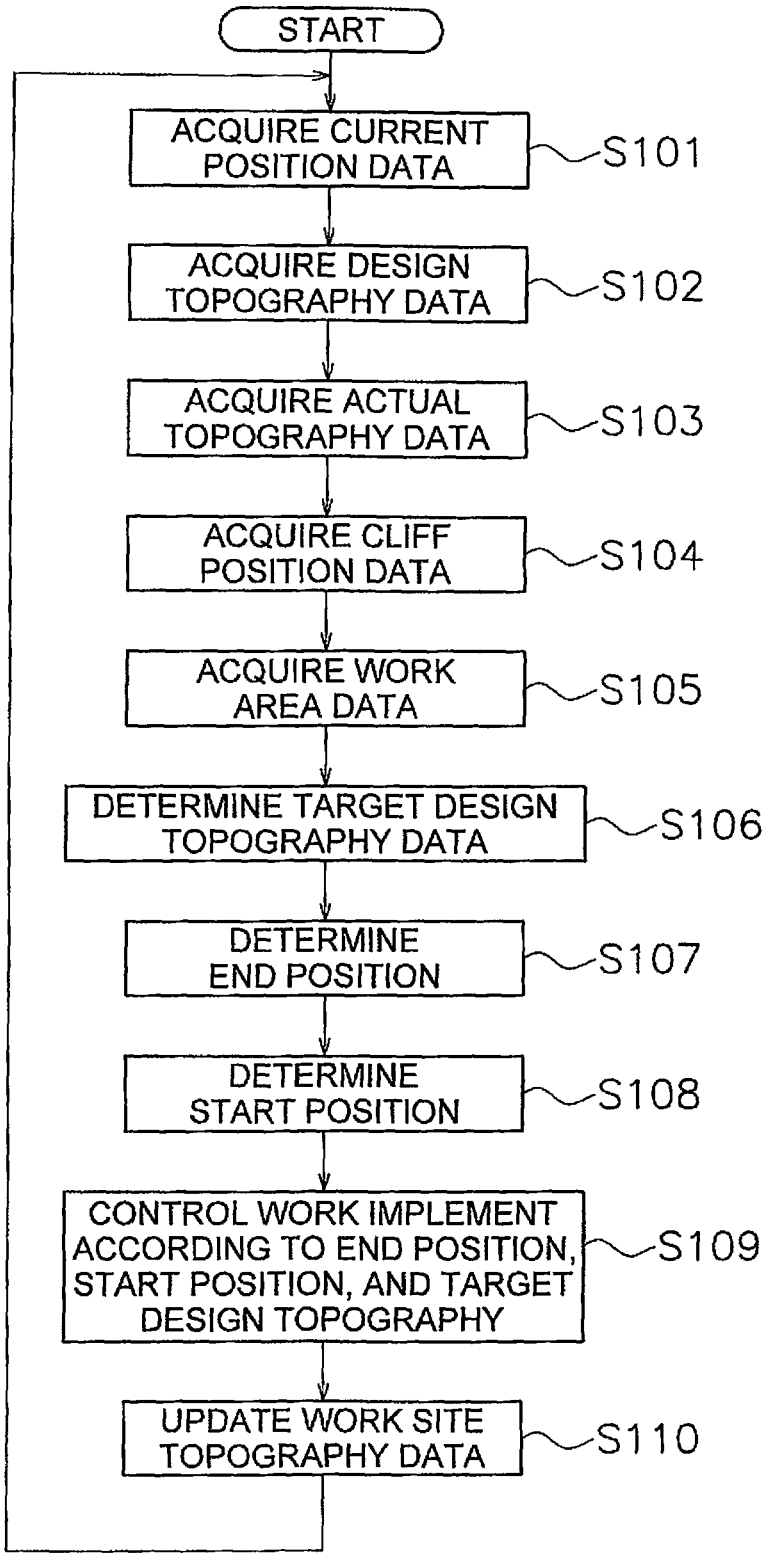
FIG. 4 is a flowchart showing a process of automatic control of the work machine.

The automatic control of the work machine 1 in digging executed by the controller 26 will be described below. In the following description, for example, the work machine 1 travels back and forth on each slot in slot dosing to dig each slot. FIG. 4 is a flowchart illustrating processing of automatic control according to the first embodiment.

As illustrated in FIG. 4, in step S101, the controller 26 acquires current position data. At this time, the controller 26 acquires the current blade tip position Pb of the blade 18 as described above.

Figure 5:
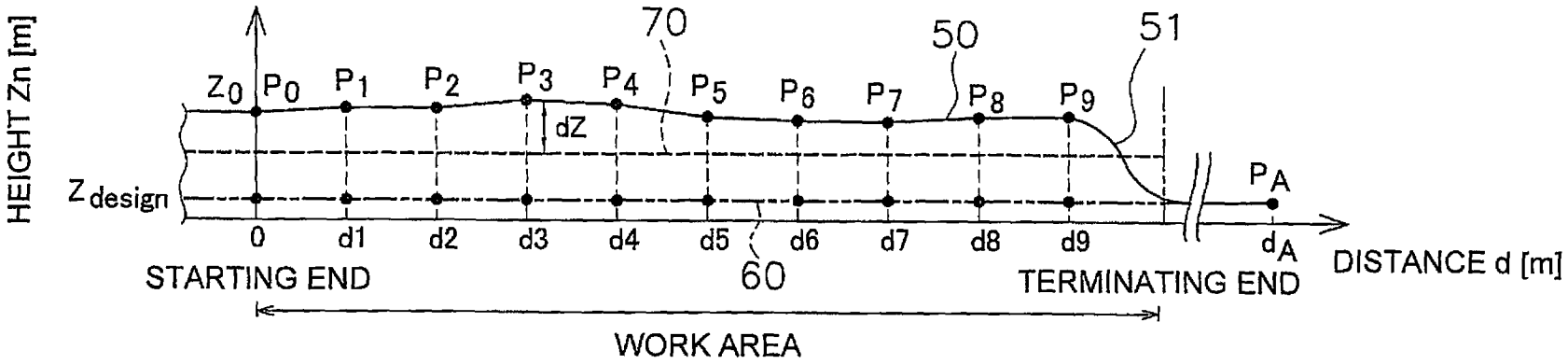
FIG. 5 is a diagram showing an example of a final design topography, an actual topography, and a target design topography.

In step S102, the controller 26 acquires design topography data. As illustrated in FIG. 5, the design topography data includes a height Zdesign of a final design topography 60 at a plurality of reference points Pn (n=0, 1, 2, 3, . . . , A) in the traveling direction of the work machine 1. The plurality of reference points Pn indicate a plurality of points at a predetermined interval along the traveling direction of the work machine 1. The plurality of reference points Pn are on a travel path of the blade 18. In FIG. 5, the final design topography 60 has a flat shape parallel to the horizontal direction, but may have a different shape.

In step S103, the controller 26 acquires actual topography data. The controller 26 acquires the actual topography data by calculation from the work site topography data acquired from the storage device 28, and the position data and traveling direction data of the vehicle body acquired from the position sensor 31.

The actual topography data is information indicative of a topography positioned in the traveling direction of the work machine 1. FIG. 5 illustrates a cross section of an actual topography 50. In FIG. 5, the vertical axis indicates the height of the topography, and the horizontal axis indicates the distance from the current position in the traveling direction of the work machine 1.

Specifically, the actual topography data includes the height Zn of the actual topography 50 at the plurality of reference points Pn from the current position to a predetermined topography recognition distance dA in the traveling direction of the work machine 1. In the present embodiment, the current position is a position determined based on the current blade tip position Pb of the work machine 1. The current position may be determined based on a current position of another portion of the work machine 1. The plurality of reference points are arranged at a predetermined interval, for example, every one meter.

In step S104, the controller 26 acquires cliff position data. As illustrated in FIG. 5, the cliff position data indicates a position and a shape of a cliff 51 included in the actual topography 50. The controller 26 may calculate an inclination of the actual topography from the actual topography data and detect the cliff 51 from the magnitude of the inclination. The controller 26 may obtain the position and the shape of the detected cliff 51 from the actual topography data, and acquire the cliff position data therefrom. Alternatively, the operator may input the position of the cliff 51 using the input device 25. The controller 26 may obtain the shape of the input cliff 51 from the actual topography data and acquire the shape as the cliff position data. Alternatively, the cliff position data may be stored in the storage device 28 in advance, and the controller 26 may acquire the cliff position data from the storage device 28. Alternatively, the controller 26 may acquire the cliff position data from an external computer.

In step S105, the controller 26 acquires work area data. The work area data indicates a work area set by the input device 25. As illustrated in FIG. 5, the work area includes a starting end and a terminating end. The work area data includes coordinates of the starting end and coordinates of the terminating end. Alternatively, the work area data includes the coordinates of the starting end and the length of the work area, and the coordinates of the terminating end may be calculated from the coordinates of the starting end and the length of the work area. Alternatively, the work area data includes the coordinates of the terminating end and the length of the work area, and the coordinates of the starting end may be calculated from the coordinates of the terminating end and the length of the work area.

The controller 26 acquires the work area data based on an operation signal from the input device 25. The controller 26 may acquire the work area data by another method. For example, the controller 26 may acquire the work area data from an external computer that performs construction management of the work site.

In step S106, the controller 26 determines target design topography data. The target design topography data indicates a target design topography 70 illustrated by a dashed line in FIG. 5. The target design topography 70 indicates a desired trajectory of the tip of the blade 18 in work, that is, a target trajectory. The target design topography 70 is a target profile of the topography to be worked and indicates a desired shape as a result of digging work.

As illustrated in FIG. 5, the controller 26 determines the target design topography 70 of which at least a portion is positioned below the actual topography 50. For example, the controller 26 determines the target design topography 70 that extends in the horizontal direction. The controller 26 generates the target design topography 70 that is displaced downward from the actual topography 50 by a predetermined distance dZ. The predetermined distance dZ may be set based on an operation signal from the input device 25. The predetermined distance dZ may be acquired from an external computer that performs construction management of the work site. The predetermined distance dZ may be a fixed value.

The controller 26 determines the target design topography 70 so that the target design topography 70 does not go below the final design topography 60. Therefore, the controller 26 determines the target design topography 70 positioned at or above the final design topography 60 and below the actual topography 50 during digging work.

Figure 6:
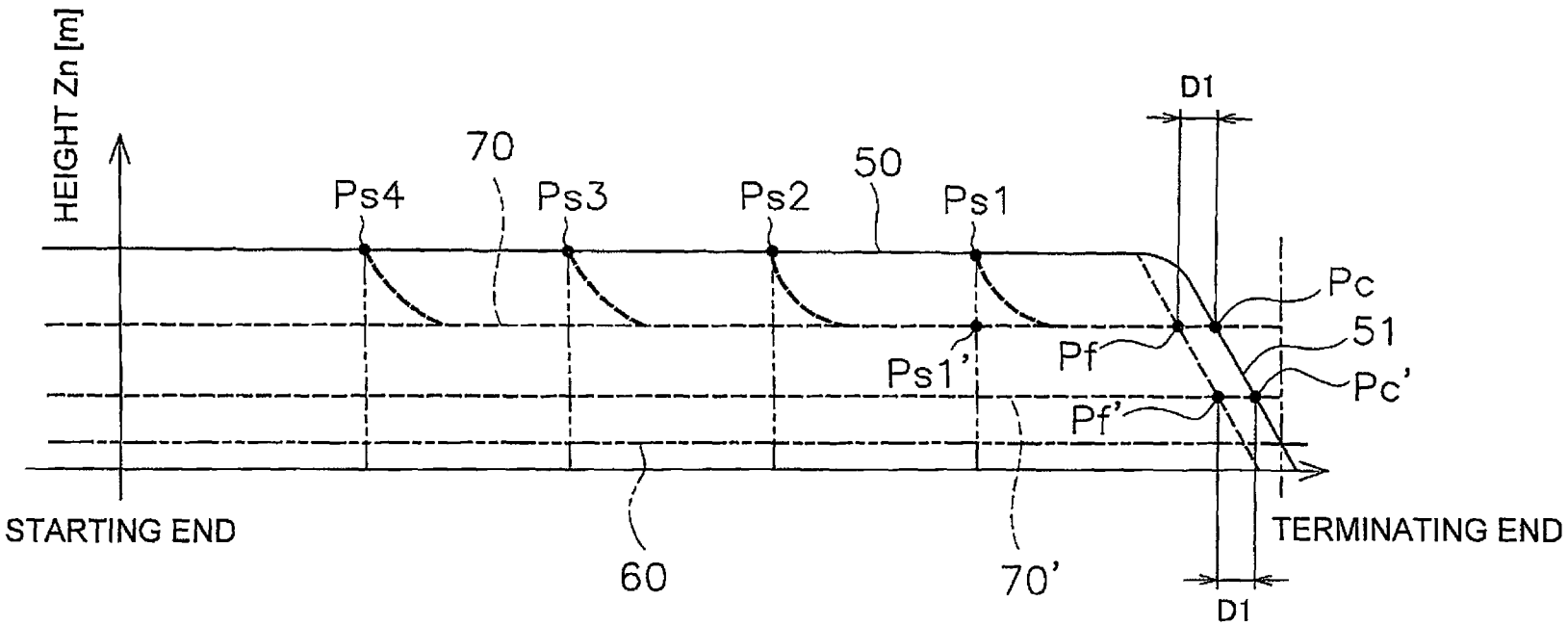
FIG. 6 is a diagram showing a method for determining an end position of work according to a first embodiment.

In step S107, the controller 26 determines an end position Pf. FIG. 6 is a diagram illustrating a method for determining an end position Pf and a start position Ps1 according to a first embodiment. As illustrated in FIG. 6, the controller 26 determines the end position Pf from the target design topography 70 and the cliff position data. Specifically, the controller 26 calculates a position of the intersection Pc of the cliff 51 and the target design topography 70. The controller 26 determines, as the end position Pf, a point backwardly away from the position of the intersection Pc by a predetermined distance D1.

Preferably, the predetermined distance D1 is determined in consideration of work efficiency. The predetermined distance D1 may be a constant value. Alternatively, the predetermined distance D1 may be set by an operator. Alternatively, the predetermined distance D1 may be automatically determined by the controller 26 according to the mechanical capability of the work machine 1, the capacity of the blade 18, or the like.

In step S108, the controller 26 determines a start position Ps1. As illustrated in FIG. 6, the controller 26 determines a plurality of start positions Ps1-Ps4 arranged in the traveling direction of the work machine 1. Each start position Ps1-Ps4 is a position at which the work for one cut by the blade 18 is started. The work for one cut means digging work by the blade 18 in one forward travel of the work machine 1. The controller 26 may determine, as the first start position Ps1, a position backwardly away from the end position Pf by a predetermined section distance. The controller 26 may determine another start position Ps2-Ps4 such that the distance between the start positions Ps1-Ps4 matches the predetermined section distance.

The predetermined section distance may be a constant value. Alternatively, the predetermined section distance may be set by an operator. Alternatively, the predetermined section distance may be automatically determined by the controller 26 according to the mechanical capacity of the work machine 1, the capacity of the blade 18, an amount of material to be dug, or the like.

In step S109, the controller 26 controls the work implement 13 according to the end position Pf, the start position Ps1, and the target design topography 70. The controller 26 starts the work from the first start position Ps1, and generates a command signal to the work implement 13 so that the blade tip position of the blade 18 moves according to the target design topography 70. The generated command signal is input to the control valve 27. Thereby, the blade tip position Pb of the blade 18 moves from the first start position Ps1 toward the target design topography 70.

The controller 26 advances the work machine 1 until the blade tip position Pb of the blade 18 reaches the end position Pf. As a result, the material held by the blade 18 is dropped from the cliff 51. When the blade tip position Pb of the blade 18 reaches the end position Pf, the controller 26 retracts the work machine 1. Thereby, the work in one work section from the first start position Ps1 is completed.

When the digging of the work section from the first start position Ps1 is completed, the controller 26 moves the work machine 1 to the second start position Ps2, and digs the work section from the next second start position Ps2. Then, the controller 26 advances the work machine 1 again until the blade tip position Pb of the blade 18 reaches the end position Pf. As a result, the material held by the blade 18 is dropped from the cliff 51.

When the blade tip position Pb of the blade 18 reaches the end position Pf, the controller 26 retracts the work machine 1. When the digging of the work section from the second start position Ps2 is completed, the controller 26 moves the work machine 1 to the third start position Ps3, and digs the work section from the next third start position Ps3. By repeating these operations, digging of one target design topography 70 is completed within the work area.

When the digging of one target design topography 70 within the work area is completed, the controller 26 sets the end position Pf' and the start position Ps1' for the next target design topography 70' located further below as illustrated in FIG. 6 and starts digging from the start position Ps1'. The controller 26 determines, as the end position Pf', a point backwardly away from the position of the intersection Pc' of the cliff 51 and the next target design topography 70' by the predetermined distance D1. By repeating such processing, digging is performed so that the actual topography 50 approaches the final design topography 60.

In step S110, the controller 26 updates the work site topography data. The controller 26 updates the work site topography data with position data indicative of the latest trajectory of the blade tip position Pb. Update of the work site topography data may be performed at any time. Alternatively, the controller 26 may calculate the position of the bottom surface of the crawler belt 16 from the vehicle body position data and the vehicle body dimension data, and may update the work site topography data with the position data indicative of the trajectory of the bottom surface of the crawler belt 16. The controller 26 may update the work site topography data with a positioning signal output from a vehicle-mounted LIDAR. In these cases, the update of the work site topography data can be performed immediately.

Alternatively, the work site topography data may be generated from survey data measured by a surveying device external to the work machine 1. As an external surveying device, for example, aerial laser surveying may be used.

Alternatively, the actual topography 50 may be imaged by a camera, and the work site topography data may be generated from image data obtained by the camera. For example, an aerial survey using a UAV (Unmanned Aerial vehicle) may be used. In the case of an external surveying device or camera, the update of the work site topography data may be performed at predetermined intervals or at any time.

In the control system 3 of the work machine 1 according to the present embodiment described above, the cliff position data indicative of the position of the cliff 51 is obtained, and the end position Pf of the work is determined from the cliff position data. Therefore, the end position Pf can be determined according to an actual change in the position or shape of the cliff 51. Thereby, a desired topography can be accurately formed, and a decrease in work efficiency can be suppressed.

The end position Pf is determined from a point backwardly away by a predetermined distance D1 from the position of the intersection Pc of the cliff 51 and the target design topography 70. Therefore, the end position Pf is determined according to the actual shape of the cliff 51. This prevents the material from being not dropped and remaining at the end of the cliff 51. Thereby, a desired topography can be accurately formed, and a decrease in work efficiency can be suppressed.

Although embodiments of the present invention has been described so far, the present invention is not limited to the above embodiments and various modifications may be made within the scope of the invention.

The work machine 1 is not limited to a bulldozer, and may be another vehicle such as a wheel loader, a motor grader, a hydraulic excavator, or the like.

The work machine 1 may be remotely operable. In this case, a portion of the control system 3 may be disposed outside of the work machine 1. For example, the controller 26 may be disposed outside of the work machine 1. The controller 26 may be positioned in a control center that is away from the work site. In this case, the work machine 1 may be a vehicle that does not include the operating cabin 14.

The work machine 1 may be a vehicle driven by an electric motor. In this case, a power supply may be positioned outside the work machine 1. The work machine 1 to which the power is supplied from the outside may be a vehicle without an internal combustion engine and an engine compartment.

Figure 7:
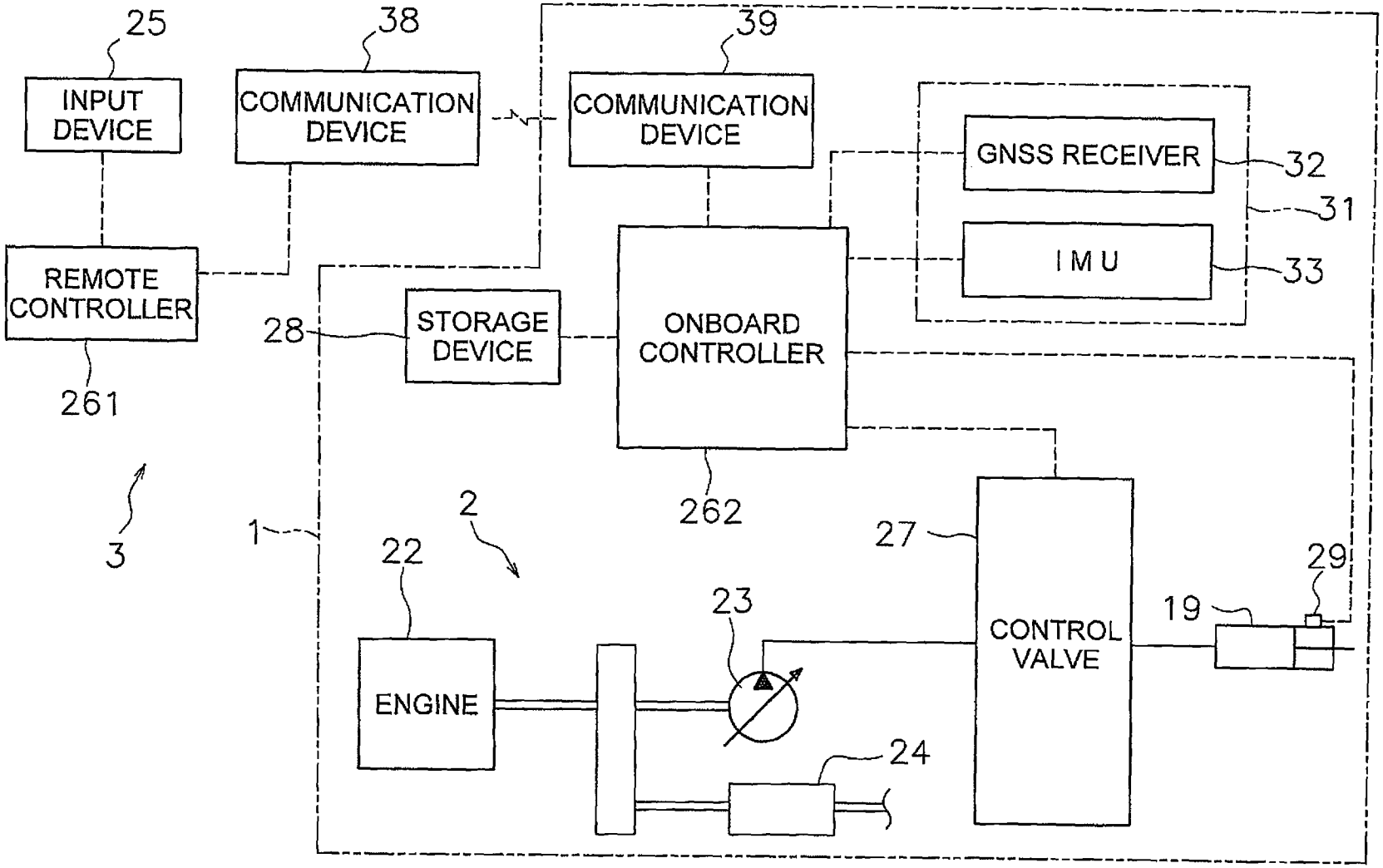
FIG. 7 is a block diagram showing a configuration according to a first modification of the control system.

The controller 26 may have a plurality of controllers 26 separated from one another. For example, as illustrated in FIG. 7, the controller 26 may include a remote controller 261 disposed outside of the work machine 1 and an onboard controller 262 mounted on the work machine 1. The remote controller 261 and the onboard controller 262 may be able to communicate wirelessly via communication devices 38 and 39. Some of the aforementioned functions of the controller 26 may be executed by the remote controller 261, and the remaining functions may be executed by the onboard controller 262. For example, the processing for determining the target design topography 70 and the work sequence may be executed by the remote controller 261, and the processing for outputting a command signal to the work implement 13 may be executed by the onboard controller 262.

The input device 25 may be positioned outside the work machine 1. In this case, the operating cabin may be omitted from the work machine 1. Alternatively, the input device 25 may be omitted from the work machine 1. The input device 25 may include an operating member such as an operating lever, a pedal, a switch for operating the travel device 12 and/or the work implement 13. The traveling back and forth of the work machine 1 may be controlled according to the operation of the input device 25. The movement such as raising and lowering of the work implement 13 may be controlled according to the operation of the input device 25.

Figure 8:
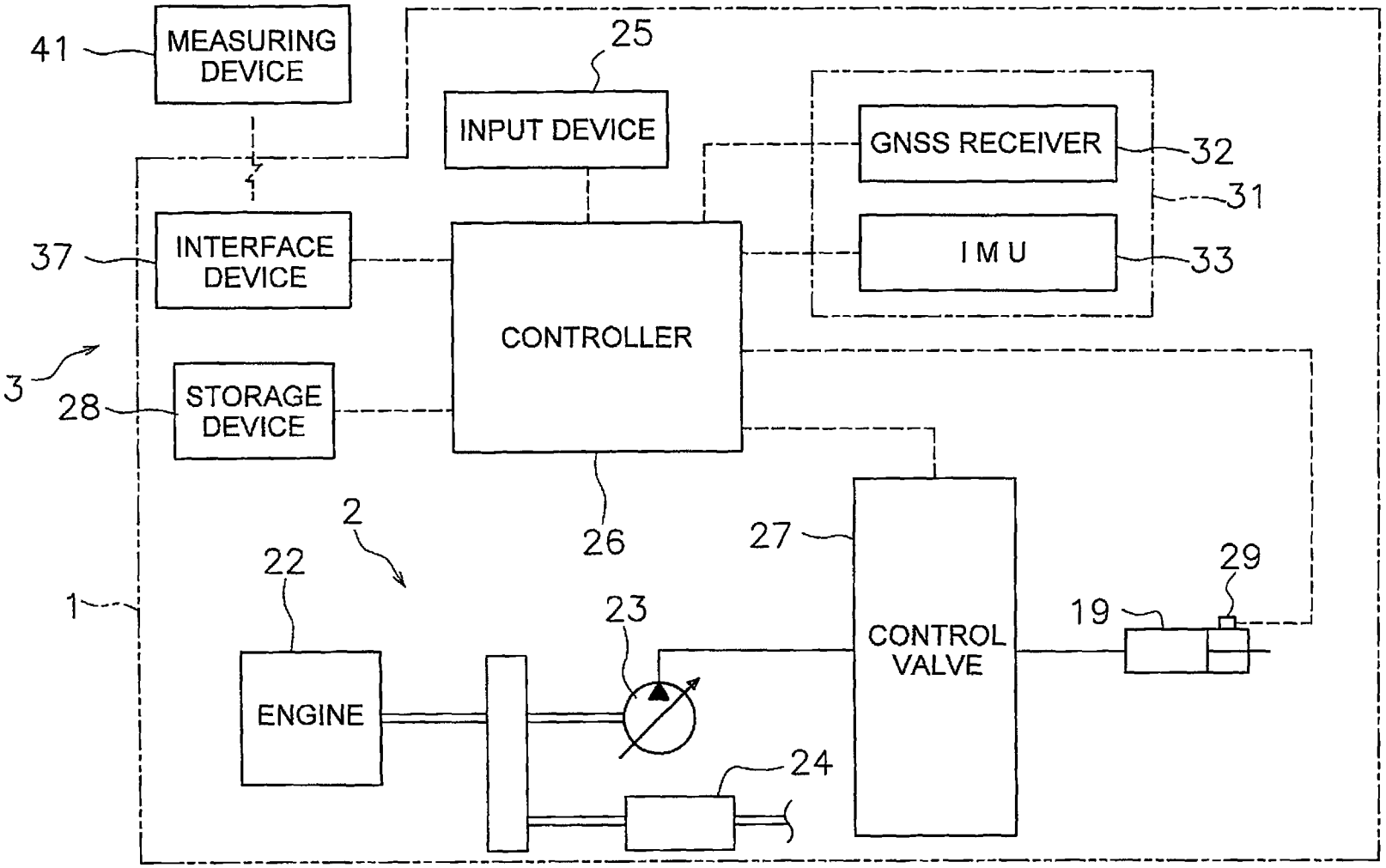
FIG. 8 is a block diagram showing a configuration according to a second modification of the control system.

The actual topography 50 may be acquired by another device, instead of the aforementioned position sensor 31. For example, as illustrated in FIG. 8, the actual topography 50 may be acquired by an interface device 37 that receives data from an external device. The interface device 37 may wirelessly receive the actual topography 50 data measured by an external measuring device 41. Alternatively, the interface device 37 may be a recording medium reading device and may receive the actual topography 50 data measured by the external measuring device 41 via the recording medium.

The method for determining the target design topography 70 is not limited to that of the above embodiment, and may be changed. For example, the target design topography 70 may be a topography acquired by vertically displacing the actual topography 50 by a predetermined distance. Alternatively, the target design topography 70 may be a topography inclined at a predetermined angle with respect to the horizontal direction. The predetermined angle may be set by the operator. Alternatively, the controller 26 may automatically determine the predetermined angle.

Figure 9:
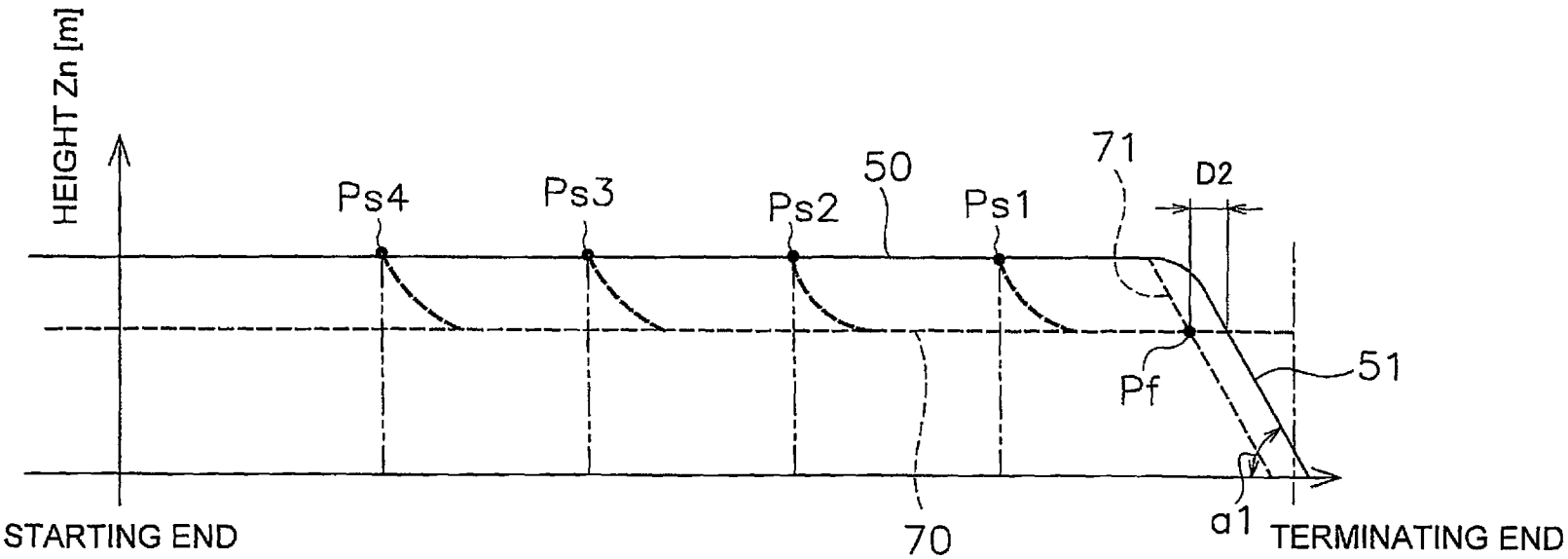
FIG. 9 is a diagram showing g a method for determining an end position of work according to a second embodiment.
Figure 10:
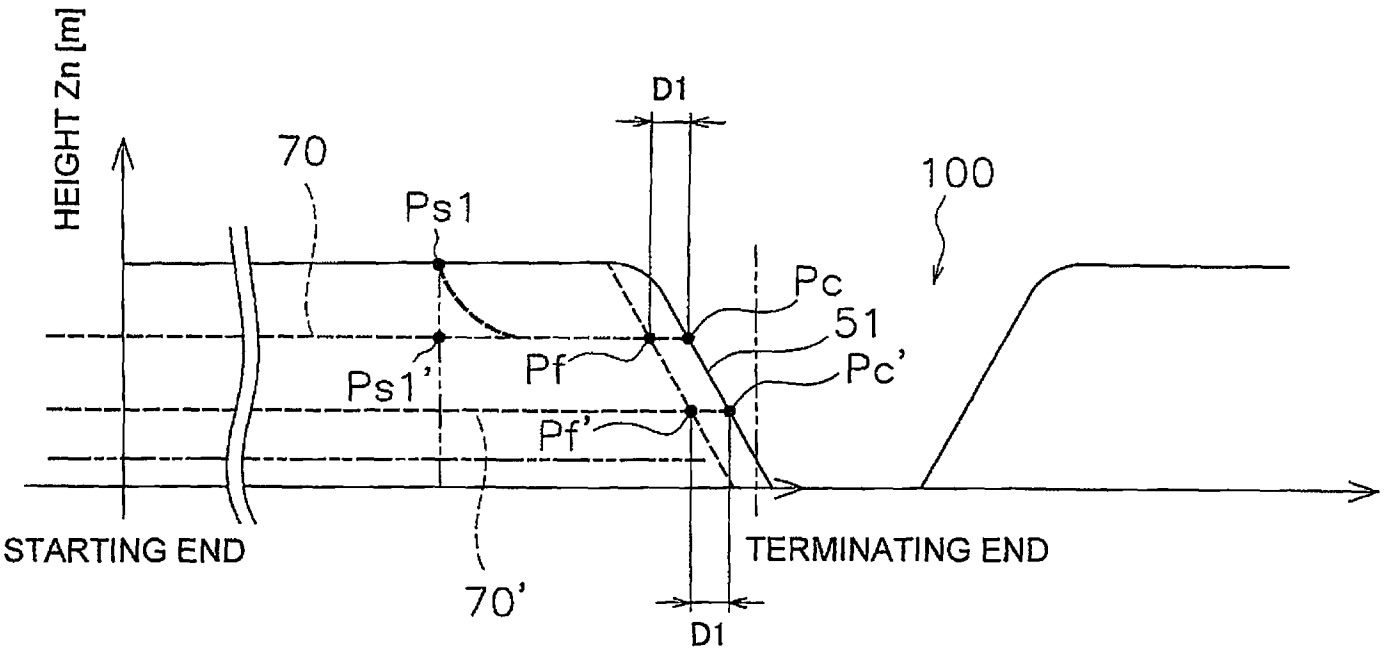
FIG. 10 is a diagram showing another example of the actual topography.

The processing for determining the end position Pf is not limited to the above-described embodiment, and may be changed. FIG. 10 is a diagram illustrating a method for determining the end position Pf according to a second embodiment. As illustrated in FIG. 9, the controller 26 calculates the inclination angle a1 of the cliff 51 from the cliff position data. The controller 26 determines, based on the cliff position data, an inclined surface 71 that is backwardly away from the cliff 51 by a predetermined distance D2 in the traveling direction of the work machine 1. The inclined surface 71 is inclined at the same angle as the inclination angle a1 of the cliff 51. The inclined surface 71 has a shape along the cliff 51. The controller 26 determines, as the end position Pf, a position of the intersection of the inclined surface 71 and the target design topography 70.

Preferably, the predetermined distance D2 is determined in consideration of work efficiency. The predetermined distance D2 may be a constant value. Alternatively, the predetermined distance D2 may be set by an operator. Alternatively, the predetermined distance D2 may be automatically determined by the controller 26 according to the mechanical capability of the work machine 1, the capacity of the blade 18, or the like.

In the above embodiment, the start positions Ps1-Ps4 are automatically determined by the controller 26. However, the start positions Ps1-Ps4 may be determined by an operator. That is, the start positions Ps1-Ps4 may be positions where the operator manually operates the work implement 13 to start digging.

The shape of the cliff 51 may be different from that of the above embodiment. For example, the cliff 51 may be a part of the hole 100 as illustrated in FIG. 10.

According to the present invention, when working near a cliff by automatic control of a work machine, desired topography can be created.

The invention claimed is:

1. A control system for a work machine including a work implement, the control system comprising:

a controller configured to acquire cliff position data indicative of a position of a cliff included in an actual topography of a work site, determine a target design topography located below the actual topography, calculate a position of an intersection of the cliff and the target design topography, determine an end position of work by the work implement from the cliff position data, the end position being determined as a point backwardly away from the position of the intersection by a predetermined distance in a traveling direction of the work machine, and generate a command signal to move the work implement according to the end position and the target design topography.

2. A method performed by a controller for controlling a work machine including a work implement, the method comprising:

acquiring cliff position data indicative of a position of a cliff included in an actual topography of a work site;

determining a target design topography located below the actual topography;

determining an end position of work by the work implement from the cliff position data, the determining the end position including calculating a position of an intersection of the cliff and the target design topography, and determining, as the end position, a point backwardly away from the position of the intersection by a predetermined distance in a traveling direction of the work implement; and generating a command signal to move the work implement according to the end position and the target design topography.

3. A work machine comprising:

a work implement; and a controller configured to control the work implement, the controller being configured to acquire cliff position data indicative of a position of a cliff included in an actual topography of a work site, determine the target design topography located below the actual topography, calculate a position of an intersection of the cliff and the target design topography, determine an end position of work by the work implement from the cliff position data, the end position being determined as a point backwardly from the position of the intersection by a predetermined distance in a traveling direction of the work machine, and generate a command signal to move the work implement according to the end position and the target design topography.

4. A control system for a work machine including a work implement, the control system comprising:

a controller configured to acquire cliff position data indicative of a position of a cliff included in an actual topography of a work site, determine a target design topography located below the actual topography, determine an inclined surface backwardly a predetermined distance away from the cliff in a traveling direction of the work machine from the cliff position data, determine an end position of work by the work implement from the cliff position data, determine a position of the intersection of the inclined surface and the target design topography as the end position, and generate a command signal to move the work implement according to the end position and the target design topography.

5. The control system for a work machine according to claim 4, wherein the controller is further configured to calculate an inclination angle of the cliff from the cliff position data, and the inclined surface is inclined at a same angle as the inclination angle of the cliff.

6. The control system for a work machine according to claim 4, wherein the inclined surface has a shape along the cliff.

7. A work machine comprising:

a work implement; and a controller configured to control the work implement, the controller being configured to acquire cliff position data indicative of a position of a cliff included in an actual topography of a work site, determine the target design topography located below the actual topography, determine an inclined surface backwardly a predetermined distance away from the cliff in a traveling direction of the work machine from the cliff position data, determine an end position of work by the work implement from the cliff position data, determine a position of the intersection of the inclined surface and the target design topography as the end position, and generate a command signal to move the work implement according to the end position and the target design topography.

8. The work machine according to claim 7, wherein the controller is further configured to calculate an inclination angle of the cliff from the cliff position data, and the inclined surface is inclined at a same angle as the inclination angle of the cliff.

9. The work machine according to claim 7, wherein the inclined surface has a shape along the cliff.

10. A method performed by a controller for controlling a work machine including a work implement, the method comprising:

acquiring cliff position data indicative of a position of a cliff included in an actual topography of a work site;

determining a target design topography located below the actual topography;

determining an end position of work by the work implement from the cliff position data, the determining the end position including determining an inclined surface backwardly a predetermined distance away from the cliff in a traveling direction of the work machine from the cliff position data, and determining a position of the intersection of the inclined surface and the target design topography as the end position; and generating a command signal to move the work implement according to the end position and the target design topography.

11. The method according to claim 10, wherein the determining the end position further includes calculating an inclined angle of the cliff from the cliff position data, and the inclined surface is inclined at a same angle as the inclination angle of the cliff.

12. The method according to claim 10, wherein the inclined surface has a shape along the cliff.

* * * * *